United States Patent [19]

Fischer

[11] Patent Number: 4,815,254

[45] Date of Patent: Mar. 28, 1989

[54] PROCESS FOR ERECTING AND CLOSING A FOLDING CARTON AND APPARATUS FOR CARRYING OUT THIS PROCESS

[75] Inventor: Wilhelm Fischer, Durach, Fed. Rep. of Germany

[73] Assignee: Unilever Patent Holdings B.V., Rotterdam, Netherlands

[21] Appl. No.: 69,988

[22] Filed: Jul. 6, 1987

[30] Foreign Application Priority Data

Jul. 11, 1986 [DE] Fed. Rep. of Germany ..... 3623354

[51] Int. Cl.[4] ..... B65B 11/10; B65B 49/04

[52] U.S. Cl. ..... 53/456; 53/209; 53/374; 53/462; 53/468

[58] Field of Search ..... 53/456, 462, 461, 467, 53/468, 209, 207, 231, 230, 374, 382; 493/302, 295

[56] References Cited

U.S. PATENT DOCUMENTS

| | | | |
|---|---|---|---|
| 1,950,765 | 3/1934 | Winter | 53/209 X |
| 3,296,769 | 1/1967 | Patton | 53/382 X |
| 3,381,810 | 5/1968 | Lasher et al. | 53/456 X |
| 3,516,219 | 6/1970 | Nigrelli et al. | 53/209 X |
| 3,543,469 | 12/1970 | Ullman | 53/456 |
| 3,716,962 | 2/1973 | Langen et al. | 53/374 X |
| 4,562,687 | 1/1986 | Green, Jr. | 53/374 X |
| 4,571,916 | 2/1986 | Meuwly et al. | 53/374 X |

*Primary Examiner*—James F. Coan

*Attorney, Agent, or Firm*—Cushman, Darby & Cushman

[57] ABSTRACT

A process and an apparatus for erecting and closing a folding carton made from a one-piece board blank consisting of base, side and top panels connected by folding lines. The board blank is transported with its base panel (5) facing downwards through a device in which the side and top panels (7,9) are folded upwards and on top of each other. A fixed tongue (12) which is fastened at one end from above and is located inside the sleeve-shaped folding carton once the top panels have been folded into position, is provided to support the top panels (9). The transport unit has supports (14) which move with it, engage the underneath of the tongue and give it support against downward pressure.

5 Claims, 2 Drawing Sheets

Figure 1:
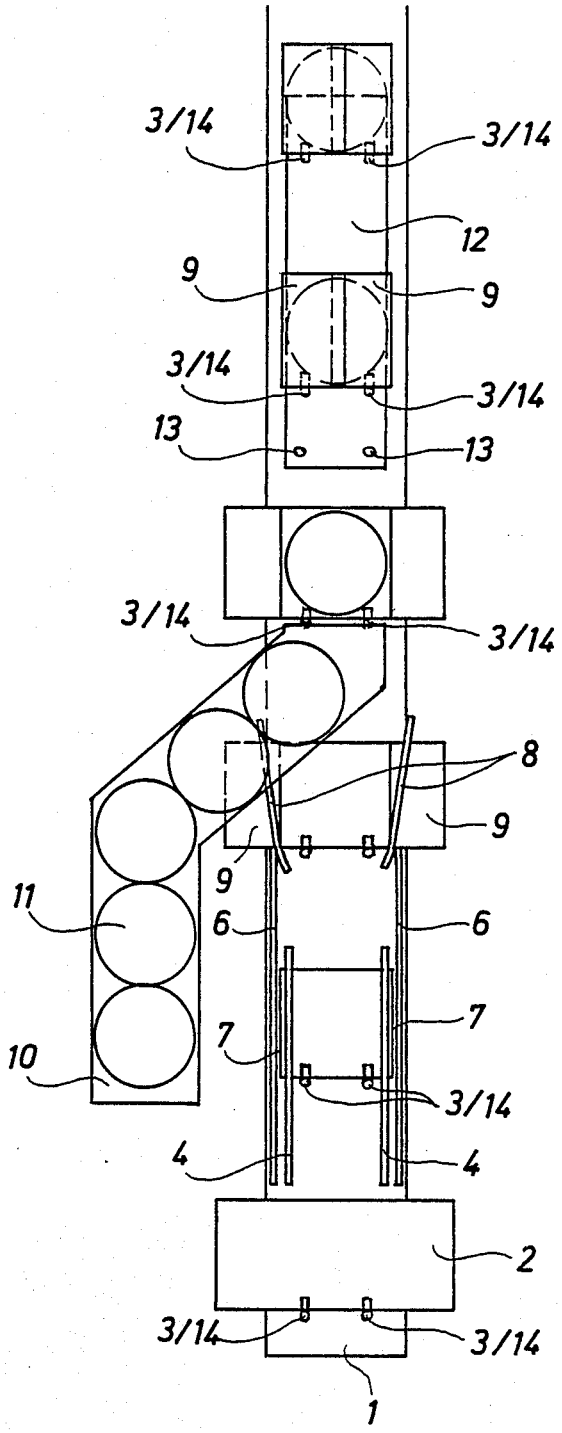

PROCESS FOR ERECTING AND CLOSING A FOLDING CARTON AND APPARATUS FOR CARRYING OUT THIS PROCESS

BACKGROUND OF THE INVENTION

The invention relates to a process for erecting and closing a folding carton made from a one-piece board blank consisting of base, side and top panels connected by folding lines as well as to an apparatus for carrying out this process.

The way such processes generally work is to place the top panel of the board blank onto the product that is to be packaged, after which fixed folding elements fold the side panels and then the base panels into position. The final operation is to seal the base panels. During the whole of this process it is necessary to hold and guide the product being packaged in such a way that the base panels can be folded into place.

An obvious alternative is to arrange the folding and closing operations the other way round, i.e. to place the product being packaged onto the base panel of the board blank and to fold the side and top panels upwards. When the pack is closed, however, the top panels are supported by the product which is not an acceptable solution when sensitive products are being processed.

SUMMARY OF THE INVENTION

The purpose of the present invention is to propose a process and an apparatus which carries out this process as simple as possible while at the same time making sure that the product is not harmed.

The way the present invention achieves this purpose is to transport the board blank with its base panel resting on a transport unit through a device in which first of all the side panels of the board blank are folded upwards through 90 degrees and then the top panels are folded outwards through 90 degrees, after which the top panels are folded inwards around a fixed tongue, following which any side panels provided on the end panels are also folded and glued together.

This procedure is very simple and is carried out completely independently of any product. There is no question here of using the product for support.

An advantageous apparatus for carrying out this invention is designed in such a way that a chain is provided as the transport unit with carriers for the board blank which have supports that provide support from below for a tongue fastened at only one end while the board blank passes through and the top panels are folded.

The folding carton has now been folded into a "U" shape and has no trouble in passing by the fastened end of the tongue. The folding carton is then folded around the tongue to form a sleeve. This can now leave the tongue together with the supports.

A very advantageous further development of the invention is the provision of a unit for transporting the one-piece product being loaded into the folding carton when the top is still open.

Particularly efficient filling is possible with this system, since the product is loaded from above while the board blank is being erected and transported.

It is also very advantageous if in accordance with the present invention the carriers for the board blank are designed at the same time to be the carriers for the one-piece product and engage the same.

It is particularly effective if the carriers have a neck section to engage the board blank and a head section projecting in the transport direction to engage the product.

This guarantees that the board blank and the product are both transported held securely in position.

BRIEF DESCRIPTION OF THE INVENTION

The drawings show one embodiment of the invention.

Figure 2:
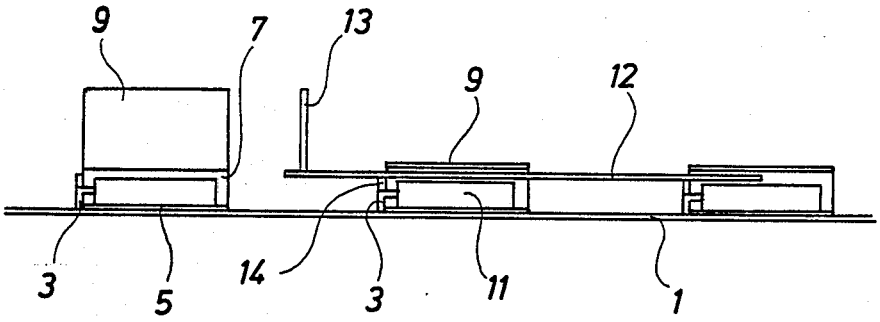
Figure 3:
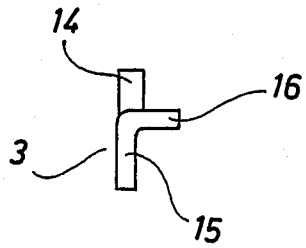

FIG. 1 is a diagram giving a top view of an apparatus for erecting, filling and closing a folding carton, FIG. 2 is a side view of part of the apparatus shown in FIG. 1 and FIG. 3 shows a carrier for the folding carton.

DETAILED DESCRIPTION OF THE INVENTION (1) in FIG. 1 is a transport unit which forms part of an apparatus for erecting and closing a folding carton. The folding carton is folded from a flat board blank (2) in several different stages.

The transport unit has carriers (3) arranged in pairs, one of which is illustrated in greater detail in FIG. 3. This pair of carriers engages the back edge of the board blank (2) in transport direction and guarantees that it is transported reliably without lateral mis-alignment.

Two folding rules (4), which hold the base section (5) of the folding carton in place while two other folding bars (6) fold its side panels (7) vertically upwards and support it during further processing, are located above the transport unit. They are followed by two curved bars (8) which fold the two top panels (9) outwards through 90 degrees while maintaining the vertical position of the side panels. Folded open in this way, the folding carton passes underneath a conveyor unit (10) which transports the product (11) and pushes it individually onto the base section (5). The folding carton, which is still open, is then transported together with the product, which the carriers (3) also engage, under a fixed tongue (12), which is fastened from above by two bearings (13), as can be seen particularly clearly in FIG. 2.

Folding rules not illustrated in the Figures fold the top panels (9) around the tongue (12), so that the pack takes on the form of a sleeve. During this operation, the free, unattached end of the tongue (12) is supported by supports (14), so that the pressure exerted during folding is not applied to the product (11). As FIG. 3 shows, the carrier (3) has a neck section (15), with which it engages the board blank, and a head section (16) which serves to transport the product. The support (14) that supports the tongue from below is located on top of both.

It is possible with such an apparatus to package even sensitive products without harming them.

I claim:

1. A process for erecting and closing a folding carton made from a one-piece board blank comprising base, side and top panels connected by folding lines, wherein the board blank (2) is transported with its base panel (5) resting on a transport unit (1) through a device in which first of all the side panels (7) of the board blank are folded upwards through 90 degrees and then the top panels (9) are folded inwards around a fixed tongue (12) until they overlap and are glued together while supporting said fixed tongue during the inwards folding, overlapping and gluing to prevent the side panels from engaging any object supported on the base panel, following which any side panels provided on the end panels are also folded and glued together.

2. An apparatus for erecting and closing a folding carton made from a one-piece board blank comprising base, side and top panels connected by folding lines, the apparatus comprising a transport unit including chain means having spaced apart carriers for moving the board blanks along a path defined by the transport unit, said path including a first station where the side panels of the board blank are folded upwardly through 90 degrees, a second station where the free end of the side panels are folded outwardly through an angle of 90 degrees and a third station including a fixed tongue extending over a portion of said path and about which the free ends are folded towards each other to overlap and close over the base panel, each said carrier of said transport unit having means for supporting said fixed tongue as a said carrier unit is passed beneath said fixed tongue so that said fixed tongue will prevent the free ends of the side panels from engaging any object carried on the base panel while the free ends are folded at said third station.

3. An apparatus according to claim 2, wherein a unit is provided for transporting the one-piece product (11) being loaded into the folding carton while the side panels are still open.

4. An apparatus according to claim 3, wherein the carriers (3) for the board blank (2) include carrier elements for the one-piece product (11) and engage the same.

5. An apparatus according to claim 4, wherein the carriers (3) have a neck section (15) to engage the board blank (2) and a head section (16) projecting in the transport direction to engage the product (11).

* * * * *